US011785701B2

(12) United States Patent
Ebe

(10) Patent No.: US 11,785,701 B2
(45) Date of Patent: Oct. 10, 2023

(54) PLASMA GENERATOR

(71) Applicant: EMD CORPORATION, Yasu (JP)

(72) Inventor: Akinori Ebe, Kyoto (JP)

(73) Assignee: EMD CORPORATION, Shiga (JP)

( * ) Notice: Subject to any disclaimer, the term of this patent is extended or adjusted under 35 U.S.C. 154(b) by 0 days.

(21) Appl. No.: 17/920,506

(22) PCT Filed: May 7, 2021

(86) PCT No.: PCT/JP2021/017603

§ 371 (c)(1),
(2) Date: Oct. 21, 2022

(87) PCT Pub. No.: WO2021/230174

PCT Pub. Date: Nov. 18, 2021

(65) Prior Publication Data

US 2023/0143330 A1 May 11, 2023

(30) Foreign Application Priority Data

May 11, 2020 (JP) ..... 2020-083481

(51) Int. Cl.
*H05H 1/24* (2006.01)

(52) U.S. Cl.
CPC ..... *H05H 1/2439* (2021.05); *H05H 1/2425* (2021.05)

(58) Field of Classification Search
CPC ..... H05H 1/2439; H05H 1/2425
See application file for complete search history.

(56) References Cited

U.S. PATENT DOCUMENTS

2005/0214181 A1* 9/2005 Kaneko ..... B01D 53/32 422/186.04
2006/0115391 A1 6/2006 Kim et al.
2008/0128266 A1* 6/2008 Lee ..... F15D 1/12 422/186.04
2010/0068104 A1 3/2010 Kim
2010/0134947 A1 6/2010 Goudy
2010/0320916 A1 12/2010 Yagi et al.
(Continued)

FOREIGN PATENT DOCUMENTS

JP 2006-510187 A 3/2006
JP 2009-535208 A 10/2009
(Continued)

OTHER PUBLICATIONS

Jul. 20, 2021 International Search Report issued in International Patent Application No. PCT/JP2021/017603.
(Continued)

*Primary Examiner* — Mary Ellen Bowman
(74) *Attorney, Agent, or Firm* — Oliff PLC

(57) ABSTRACT

A plasma generator includes an AC power supply, a power supply electrode and a ground electrode, one of which is disposed in a gas flow path and the other of which is a conductive wall constituting the gas flow path, an inflexible connection member configured to electrically connect the AC power supply and the power supply electrode, and an insulating material (power supply side insulating material, ground side insulating material) covering a side of one of the power supply electrode and the ground electrode, the side facing the other electrode.

8 Claims, 5 Drawing Sheets

(56) References Cited

U.S. PATENT DOCUMENTS

| | | | | |
|---|---|---|---|---|
| 2015/0351212 | A1* | 12/2015 | Deane | A61L 9/00 313/356 |
| 2023/0045456 | A1* | 2/2023 | Hill | A61L 9/22 |

FOREIGN PATENT DOCUMENTS

| | | | |
|---|---|---|---|
| JP | 2017-73375 | A | 4/2017 |
| JP | 2017-107781 | A | 6/2017 |
| JP | 2018-71403 | A | 5/2018 |
| WO | 2009/091065 | A1 | 7/2009 |
| WO | 2018/205758 | A1 | 11/2018 |

OTHER PUBLICATIONS

Jul. 20, 2021 Written Opinion issued in International Patent Application No. PCT/JP2021/017603.

* cited by examiner

PLASMA GENERATOR

TECHNICAL FIELD

The present invention relates to a plasma generator, and particularly to a dielectric barrier discharge type plasma generator capable of generating plasma in substantially atmospheric pressure.

BACKGROUND ART

Conventionally, in order to suppress emission of exhaust gas discharged from a diesel engine or the like into the atmosphere in a state where particulate matter (PM) such as soot is contained, an exhaust gas treatment apparatus including a plasma generator is provided in a flow path of the exhaust gas (see, for example, Patent Literature 1). Plasma is generated in such a flow path of the exhaust gas, and the PM is decomposed into carbon dioxide and the like by bringing the PM into contact with the plasma.

In many plasma generators, plasma is generated in a plasma generation chamber (vacuum container) close to vacuum, but since the pressure in the flow path of the exhaust gas is higher than vacuum and close to atmospheric pressure, an apparatus capable of generating plasma in substantially atmospheric pressure is used as the plasma generator used in the exhaust gas treatment apparatus. One such apparatus is a dielectric barrier discharge type plasma generator for generating plasma using dielectric barrier discharge.

In a dielectric barrier discharge type plasma generator, a side of at least one electrode of a pair of electrodes is coated with an insulating material, the side facing the other electrode. When an AC voltage having a frequency in a range of several tens Hz to 100 kHz and an amplitude in a range of 500 V to 10 kV is applied between adjacent electrodes in a state where the pressure between these electrodes is set to approximately atmospheric pressure, discharge occurs between the adjacent electrodes when the absolute value of the potential difference between the adjacent electrodes exceeds a threshold within one cycle of AC. By this discharge, charges attach themselves on the insulating material, and a potential difference between the insulating materials of both electrodes decreases, and the discharge stops. When the absolute value of the potential difference between the adjacent electrodes increases within the one cycle from that state, discharge occurs again, but charges further attach themselves on the insulating material, the potential difference between the insulating materials of both electrodes decreases, and the discharge stops again. As described above, pulsed discharge occurs at a repetition frequency higher than the frequency of the AC voltage while the absolute value of the voltage between the electrodes increases within one cycle of the AC voltage.

One of a pair of electrodes constituting such a dielectric barrier discharge type plasma generator is disposed in a gas flow path of an exhaust gas treatment apparatus, and the other is disposed as a conductive wall constituting the gas flow path. As a result, discharge occurs in the gas flow path, which is a space between adjacent electrodes, and gas flowing in the gas flow path is ionized to generate plasma. Then, when the PM comes into contact with the plasma, the PM is decomposed.

CITATION LIST

Patent Literature

Patent Literature 1: JP 2018-071403 A

SUMMARY OF INVENTION

Technical Problem

In the plasma generator described in Patent Literature 1, the electrodes are connected to an AC power supply through AC wires or to ground through ground wires. A cable in which a flexible metal wire is covered with a flexible covering material is usually used for the AC wires in order to facilitate handling. In such a cable, the covering material deteriorates over time during long-term use. When the electrode in the gas flow path or the electrode that is the wall of the gas flow path receives vibration from the flow of the gas in the gas flow path, the vibration is also transmitted to the cable via the electrode connected thereto. When the cable in which the covering material is deteriorated over time comes into contact with or comes close to a member other than the electrode to which the cable is connected due to the vibration, electric leakage or undesirable discharge (other than discharge for generating plasma) may occur.

Here, the exhaust gas treatment apparatus for decomposing the PM in the exhaust gas discharged from the diesel engine or the like has been described as an example, but the same problem also occurs in a dielectric barrier discharge type plasma generator provided in a gas treatment apparatus for performing various treatments on a gas flowing in a gas flow path by ionizing the gas to generate plasma.

An object of the present invention is to provide a dielectric barrier discharge type plasma generator that is provided in a gas treatment apparatus and can prevent electric leakage and undesired discharge from occurring.

Solution to Problem

The present invention made to solve the above problems is a plasma generator provided in a gas treatment apparatus for generating plasma by ionizing gas flowing in a gas flow path, the plasma generator including:

a) an AC power supply;

b) a power supply electrode and a ground electrode, one of which is disposed in the gas flow path and the other of which is a conductive wall constituting the gas flow path;

c) an inflexible connection member configured to electrically connect the AC power supply and the power supply electrode; and d) an insulating material covering a side of one of the power supply electrode and the ground electrode, the side facing the other electrode.

In the plasma generator according to the present invention, an inflexible connection member is used to electrically connect the AC power supply and the power supply electrode. The term "inflexible" as used herein means that it is not easily deformed, and more specifically means that it vibrates within an elastic range even when vibration is applied, and the original installation state is maintained. In other words, if it is initially installed so as not to come into contact with another member or the like, a state in which it does not come into contact with another member is maintained even if it receives vibration or the like for a long period of time. Therefore, even if vibration is transmitted from the gas flowing in the gas flow path to the connection member via the power supply electrode (electrode disposed in gas flow path, or electrode that is conductive wall constituting gas flow path), the connection member does not unexpectedly come into contact with or does not come close to a member other than the power supply electrode in the plasma generator, so that it is possible to prevent electric leakage and undesirable discharge from occurring.

In the plasma generator according to the present invention, it is not necessary to cover the connection member with the covering material in order to prevent electric leakage and undesired discharge by using the inflexible connection member as described above. On the other hand, the connection member may be covered with a covering material in consideration of safety at the time of inspection or the like. Alternatively, a protective cover may be provided separately from the connection member to cover the connection member.

The insulating material may be provided only on one of the power supply electrode and the ground electrode, or may be provided on both of them.

In order to ground the ground electrode, an inflexible connection member similar to the connection member may be used.

As the AC power supply, similarly to a conventional dielectric barrier discharge type plasma generator, one for generating an AC voltage having a frequency in a range of several tens of Hz (including 50 Hz and 60 Hz that are commercial frequencies in Japan) to 100 kHz and an amplitude in a range of 500 V to 10 kV can be used.

The plasma generator according to the present invention may further include a power measurement unit configured to measure AC power output from the AC power supply, and a voltage control unit configured to control an AC voltage of the AC power according to the AC power measured by the power measurement unit. As a result, when the AC power changes due to a change in the density, component, or the like of the gas between the power supply electrode and the ground electrode, the AC power can be controlled to be within a predetermined range.

The plasma generator according to the present invention may further include an electric current waveform acquisition unit configured to acquire the waveform of the AC electric current output from the AC power supply, a pulse electric current detection unit configured to detect a pulse electric current due to discharge from the waveform of the AC electric current measured by the electric current waveform acquisition unit, and a second voltage control unit configured to control the AC voltage of the AC power according to a pulse repetition frequency of the pulse electric current detected by the pulse electric current detection unit. As a result, when the pulse repetition frequency changes due to a change in the density, component, or the like of the gas between the power supply electrode and the ground electrode, the pulse repetition frequency can be controlled to be within a predetermined range.

In the plasma generator according to the present invention, it may be possible to employ a configuration of including a plurality of sets of the combination of the power supply electrode and the ground electrode, in which a common connection member is connected to each of the power supply electrodes. According to this configuration, plasma can be simultaneously generated between a plurality of sets of the power supply electrode and the ground electrode, so that the processing capability of the gas can be increased.

In the case where a plurality of sets of the combination of the power supply electrode and the ground electrode are provided as described above, it may be possible to employ a configuration in which one of the power supply electrode and the ground electrode is a linear tubular electrode, and the plasma generator further includes a connection flow path configured to connect two of a plurality of the tubular electrodes. This makes it possible to lengthen the flow path of the gas while suppressing the size of the tubular electrode in the longitudinal direction, so that the gas treatment can be performed more reliably.

In the plasma generator according to the present invention, it may be possible to employ a configuration in which a plurality of the power supply electrodes and a plurality of the ground electrodes are alternately arranged, and a common connection member is connected to each of the power supply electrodes. As a result, plasma is generated between the power supply electrode and the ground electrode adjacent to each other, and plasma can be simultaneously generated between adjacent electrodes of the plurality of sets, so that the processing capability of the gas can be increased. In each power supply electrode, plasma is generated between the ground electrodes on both sides (that is, two ground electrodes).

In the case where a plurality of the power supply electrodes and a plurality of the ground electrodes are alternately arranged, it may be possible to employ a configuration in which the power supply electrodes and the ground electrodes are flat plate electrodes, and the plasma generator further includes a connection flow path configured to connect adjacent gas flow paths each formed between one of the power supply electrode and the ground electrode and the other of the power supply electrode and the ground electrode. This makes it possible to lengthen the gas flow path while suppressing the size of the flat plate electrode in the direction parallel to the plate, so that the gas treatment can be performed more reliably.

Advantageous Effects of Invention

According to the present invention, it is possible to prevent electric leakage and undesired discharge from occurring in a plasma generator provided in a gas treatment apparatus.

DESCRIPTION OF EMBODIMENTS

Embodiments of a plasma generator according to the present invention will be described with reference to FIGS. 1 to 9.

Figure 1:
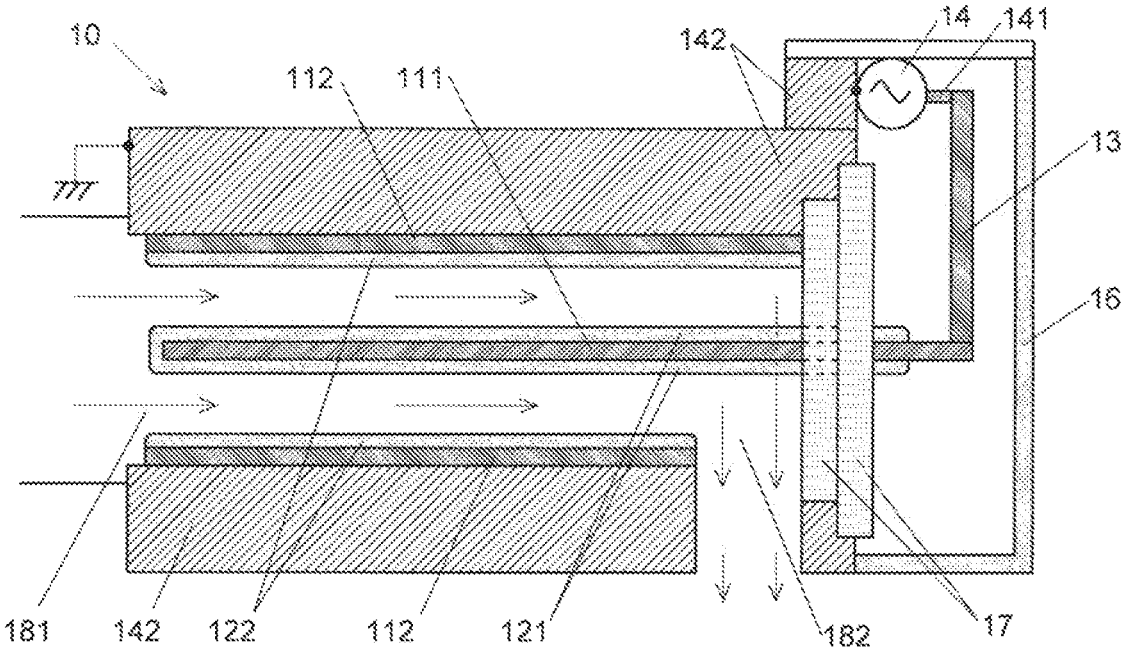
FIG. 1 is a schematic view illustrating a first embodiment of a plasma generator according to the present invention.

(1) Plasma Generator of First Embodiment (1-1) Configuration of Plasma Generator of First Embodiment FIG. 1 illustrates a schematic configuration of a plasma generator 10 of a first embodiment. The plasma generator 10 of the first embodiment is provided in a gas treatment apparatus, and includes a tube serving as a flow path of a gas which is to be treated (gas to be treated). A tube wall of the tube is made of a conductor and is grounded. This tube wall corresponds to a ground electrode 112 of the plasma generator 10. A power supply electrode 111 is disposed in a tube of the ground electrode 112, that is, in a gas flow path. In the present embodiment, the tube of the ground electrode 112 is a cylinder, and the power supply electrode 111 is a cylindrical conductor disposed at the center of the cylinder. One end (left side in FIG. 1) of the power supply electrode 111 extends to one end (left side) of the tube of the ground electrode 112, and the other end (right side) extends to the outside of the other end (right side) of the tube of the ground electrode 112.

On the side face of the cylinder of the power supply electrode 111, a power supply side insulating material 121 made of an insulator (dielectric) is provided so as to cover the entire side face. On the inner face of the tube of the ground electrode 112, a ground side insulating material 122 made of an insulator (dielectric) is provided so as to cover the entire inner face. In the present embodiment, the power supply side insulating material 121 and the ground side insulating material 122 are provided, but only one of them may be provided.

One end (lower side in FIG. 1) of a connection member 13 that is a conductor and is a rod made of an inflexible material is connected to a portion of the power supply electrode 111 extending to the outside of the tube of the ground electrode 112. The plasma generator 10 includes an AC power supply 14, and the other end (upper side) of the connection member 13 is connected to one electrode 141 of the AC power supply 14. The connection member 13 is not covered with a covering material, and is not in contact with members other than the power supply electrode 111 and the electrode 141 of the AC power supply 14.

An other electrode 142 of the AC power supply 14 is formed so as to cover the periphery of the tube of the ground electrode 112, and is grounded together with the ground electrode 112. As the AC power supply 14, one having a frequency in a range of several tens Hz to 100 kHz and an output voltage of 500 V to 10 kV is used. A Japanese commercial power supply (having a frequency of 50 Hz or 60 Hz and a voltage of 100 V or 200 V) may be used for the AC power supply 14.

For example, copper or stainless steel can be used as a material of each of the power supply electrode 111, the ground electrode 112, and the connection member 13.

On the outer side of the connection member 13, a protective cover 16 made of a plate material of an insulator (dielectric) is provided so as to be separated from the connection member 13 and cover the connection member 13. When there is no possibility that a person touches the connection member 13 while the connection member 13 is energized at the time of inspection or the like, the protective cover 16 may be omitted. In addition, instead of providing the protective cover 16, the connection member 13 may be covered with a covering material.

The other end of the tube of the ground electrode 112 is provided with a feedthrough 17 for airtightly closing an opening at the other end of the tube while allowing the power supply electrode 111 to pass therethrough. An opening is provided in the tube wall of the tube of the ground electrode 112 in front of the other end, and this opening serves as a gas discharge port 182. The opening at the one end of the tube of the ground electrode 112 serves as a gas introduction port 181.

(1-2) Operation of Plasma Generator of First Embodiment

The operation of the plasma generator 10 of the first embodiment will be described. A gas to be treated (for example, exhaust gas discharged from a diesel engine) is introduced from the gas introduction port 181 into a pipe of the ground electrode 112 serving as a gas flow path. At the same time, an AC voltage is applied between the power supply electrode 111 and the ground electrode 112 by the AC power supply 14. As a result, similarly to a conventional dielectric barrier discharge type plasma generator, pulsed discharge occurs at a repetition frequency higher than the frequency of the AC voltage while the absolute value of the voltage between the electrodes increases within one cycle of the AC voltage. By the pulsed discharge, the gas to be treated flowing in the tube of the ground electrode 112 is ionized to generate plasma, and the content of the decomposition target such as PM in contact with the plasma is decomposed. The gas to be treated that has been treated with plasma in this manner is discharged from the gas discharge port 182.

When the gas to be treated thus treated flows in the tube of the ground electrode 112, the power supply electrode 111 in the gas flow path receives vibration from the flow of the gas to be treated. This vibration is transmitted from the power supply electrode 111 to the connection member 13.

In a plasma generator provided in a conventional gas treatment apparatus, since a power supply electrode and an AC power supply are connected by a cable in which a flexible metal wire is coated with a flexible coating material, there is a possibility that a cable in which the coating material is deteriorated over time comes into contact with or comes close to a member other than an electrode in the plasma generator due to vibration received from the power supply electrode, and electric leakage or undesirable discharge occurs. On the other hand, in the plasma generator 10 of the present embodiment, since the power supply electrode 111 and the AC power supply 14 are electrically connected by the inflexible connection member 13, the connection member 13 does not come into contact with or does not come close to a member other than the electrode in the plasma generator 10 even when receiving vibration from the power supply electrode 111, and it is possible to prevent electric leakage and undesirable discharge from occurring.

(1-3) Modification of Plasma Generator of First Embodiment

Figure 2:
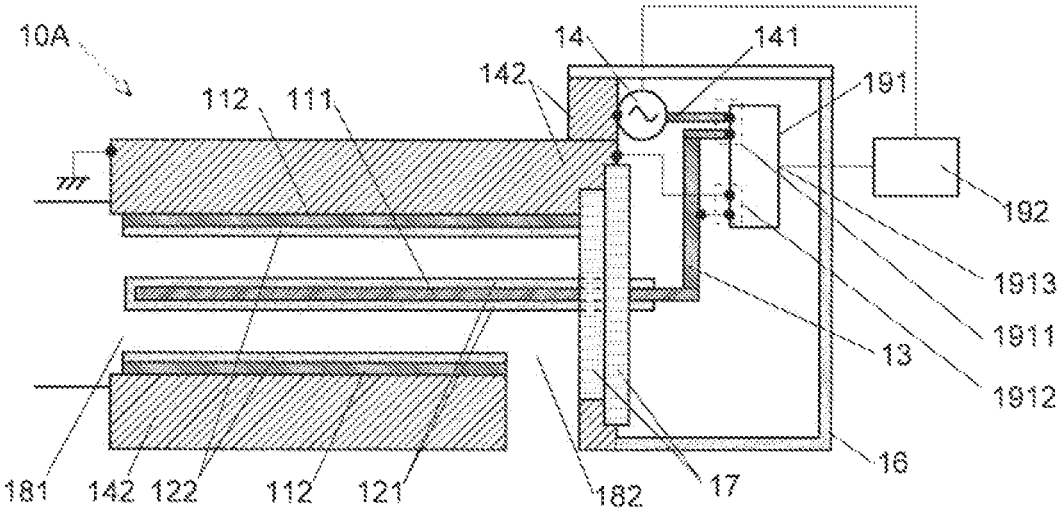
FIG. 2 is a schematic view illustrating a modification of the plasma generator of the first embodiment.

FIG. 2 illustrates a schematic configuration of a plasma generator 10A of a modification of the first embodiment. The plasma generator 10A is obtained by additionally installing a power measurement unit 191 and a voltage control unit 192 in the plasma generator 10 of the first embodiment.

The power measurement unit 191 has an electric current input terminal 1911 and a voltage input terminal 1912. The connection member 13 and the one electrode 141 of the AC power supply 14 are connected to the electric current input terminal 1911. Two cables electrically connected to the connection member 13 and the ground electrode 142 are connected to the voltage input terminal 1912. The electric current flowing through these two cables is sufficiently smaller than the electric current flowing through the connection member 13. The power measurement unit 191 obtains power on the basis of an electric signal indicating the magnitude of the electric current input from the electric current input terminal 1911 and the amplitude of the voltage input from the voltage input terminal 1912, and outputs an electric signal corresponding to the obtained power from an output terminal 1913. The output terminal 1913 is connected to the voltage control unit 192. The voltage control unit 192 controls a voltage output from the AC power supply 14 as described later according to an output signal from the power measurement unit 191.

The plasma generator 10A of the modification generates plasma in the tube of the ground electrode 112 by the same operation as the plasma generator 10 of the first embodiment. While the plasma is generated, the power measurement unit 191 measures the power output from the AC power supply 14 as needed, and transmits an output signal indicating the measurement result to the voltage control unit 192. Based on the signal input from the power measurement unit 191, the voltage control unit 192 transmits a signal of an instruction to lower the voltage to the AC power supply 14 when the value of the power output from the AC power supply 14 exceeds a predetermined range, and transmits a signal of an instruction to increase the AC voltage to the AC power supply 14 when the value of the power is below the predetermined range. As a result, even if the AC power output from the AC power supply 14 changes due to a change in the density, component, or the like of the gas between the power supply electrode 111 and the ground electrode 112, the AC power can be controlled to be within a predetermined range.

Figure 3:
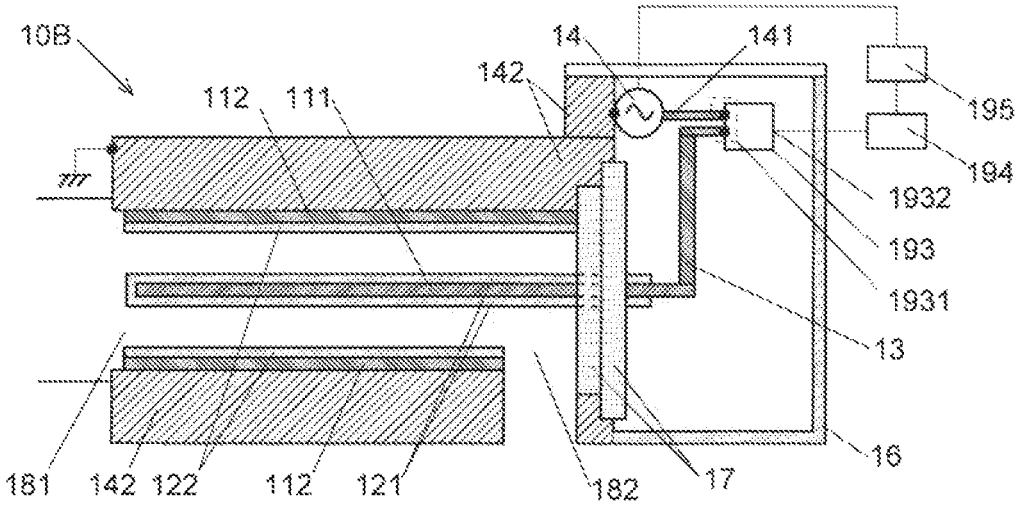
FIG. 3 is a schematic view illustrating another modification of the plasma generator of the first embodiment.

FIG. 3 illustrates a schematic configuration of a plasma generator 10B as another modification of the first embodiment. The plasma generator 10B is obtained by additionally installing an electric current waveform acquisition unit 193, a pulse electric current detection unit 194, and a second voltage control unit 195 in the plasma generator 10 of the first embodiment.

The electric current waveform acquisition unit 193 is provided with an electric current input terminal 1931 and an output terminal 1932, acquires a waveform of an AC electric current input from the electric current input terminal 1931, converts the waveform into an electric signal indicating a magnitude of the electric current, and outputs the electric signal from the output terminal 1932. The connection member 13 and the one electrode 141 of the AC power supply 14 are connected to the electric current input terminal 1931. The pulse electric current detection unit 194 is connected to the output terminal 1932. The pulse electric current detection unit 194 detects a pulse of an electric current on the basis of an electric signal input from the electric current waveform acquisition unit 193. The second voltage control unit 195 controls the voltage output from the AC power supply 14 as described later on the basis of the repetition frequency of the pulse of the detected electric current.

The plasma generator 10B of this modification generates plasma in the tube of the ground electrode 112 by the same operation as the plasma generator 10 of the first embodiment. While the plasma is generated, the electric current waveform acquisition unit 193 acquires a waveform of the AC electric current as needed, and the pulse electric current detection unit 194 detects a pulse of the electric current. When the repetition frequency of the pulse of the electric current detected by the pulse electric current detection unit 194 changes outside the predetermined range, the second voltage control unit 195 increases or decreases the voltage output from the AC power supply 14 so that the pulse repetition frequency is within the predetermined range. As a result, even if the pulse repetition frequency changes due to a change in the density, component, or the like of the gas between the power supply electrode 111 and the ground electrode 112, the pulse repetition frequency can be controlled to be within a predetermined range.

Note that the power measurement unit 191 and the voltage control unit 192 included in the plasma generator 10A, and the electric current waveform acquisition unit 193, the pulse electric current detection unit 194, and the second voltage control unit 195 included in the plasma generator 10B may be provided together. In this case, the power measurement unit 191 and the electric current waveform acquisition unit 193 can be used as one unit by using a unit having a function of acquiring the waveform of the AC electric current input from the electric current input terminal 1911 as the power measurement unit 191. In addition, the voltage control unit 192 and the second voltage control unit 195 may also be used as one unit.

(2) Plasma Generator of Second Embodiment (2-1) Configuration of Plasma Generator of Second Embodiment A plasma generator of a second embodiment will be described with reference to FIGS. 4 to 6. The plasma generator of the second embodiment includes a plurality of power supply electrodes and a plurality of ground electrodes.

Figure 4:
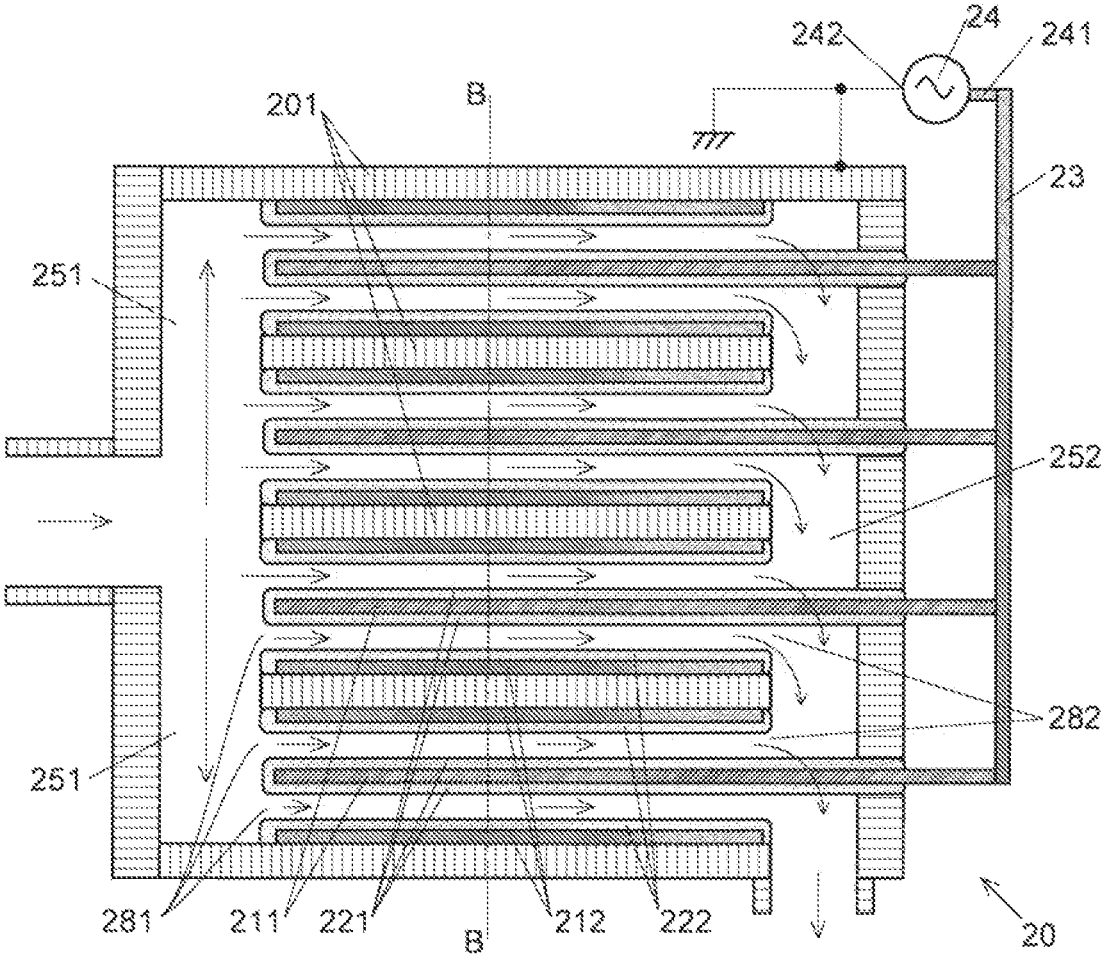
FIG. 4 is a cross-sectional view taken along line A-A illustrating a second embodiment of the plasma generator according to the present invention.
Figure 5:
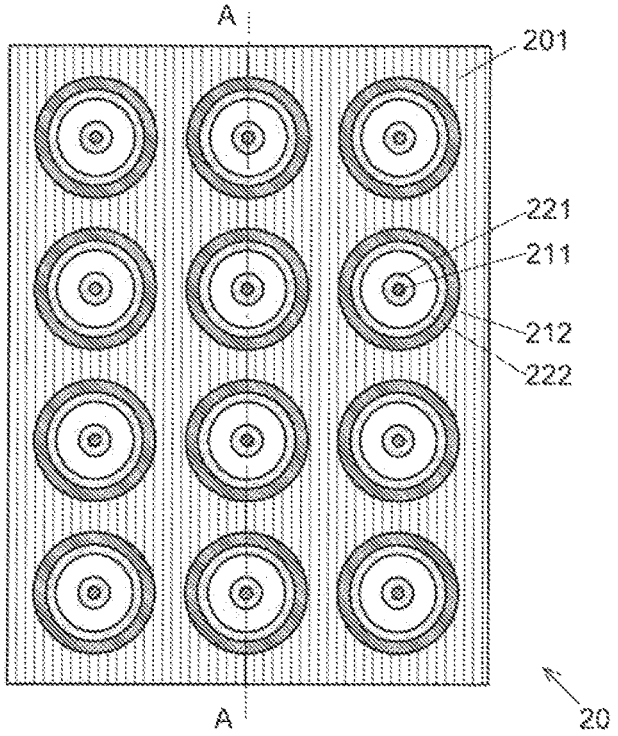
FIG. 5 is a cross-sectional view taken along line B-B of the plasma generator of the second embodiment.

FIGS. 4 and 5 are diagrams illustrating a schematic configuration of a plasma generator 20 of a second embodiment. FIG. 4 illustrates a configuration in the cross section taken along line A-A illustrated in FIG. 5, and FIG. 5 illustrates a configuration in the cross section taken along line B-B illustrated in FIG. 4.

In the plasma generator 20, a plurality of holes are provided in a conductor (for example, stainless steel) block 201, and one set of a combination of a power supply electrode 211 and a ground electrode 212 is inserted into each hole one by one. Each power supply electrode 211 and each ground electrode 212 has the same configuration as the power supply electrode 111 and the ground electrode 112 of the first embodiment. That is, the ground electrode 212 has a tubular shape, and the power supply electrode 211 is inserted into the tube of the ground electrode 212. The ground electrode 212 is in contact with the block 201, and the ground electrode 212 is also grounded by grounding the block 201. A power supply side insulating material 221 is provided on a side face of the power supply electrode 211, and a ground side insulating material 222 is provided on an inner face of the tube of the ground electrode 212.

One end of each power supply electrode 211 extends to the outside of the tube of each ground electrode 212, and is electrically connected to a common connection member 23. The connection member 23 is connected to one electrode 241 of the AC power supply 24. An other electrode 242 of the AC power supply 24 is grounded. Although not provided in the example illustrated in FIG. 4, the connection member 23 may be covered with a non-contact protective cover, or the connection member 23 may be covered with a covering material.

The block 201 is further provided with a gas introduction path 251 communicating with a gas introduction port 281 that is an opening at one end (left side in FIG. 4) of the ground electrode 212, and a gas discharge path 252 communicating with a gas discharge port 282 that is an opening at the other end (right side in FIG. 4). The gas introduction path 251 communicates with all of the gas introduction ports 281 of the plurality of ground electrodes 212, and the gas discharge path 252 communicates with all of the gas discharge ports 282 of the plurality of ground electrodes 212.

Although FIGS. 4 and 5 illustrate the example in which twelve sets of the power supply electrode 211 and the ground electrode 212 are provided, the number of combinations of the power supply electrode 211 and the ground electrode 212 is not limited thereto. One of the power supply side insulating material 221 and the ground side insulating material 222 may be omitted. Furthermore, in the present embodiment, the ground electrode 212 is provided separately from the block 201, but only the power supply electrode 211 (covered with the power supply side insulating material 221 as necessary) may be inserted into the hole provided in the block 201, and the block 201 itself may be used as the ground electrode. In this case, the ground side insulating material can be formed by covering the inner face of the hole provided in the block 201 with the insulating material.

(2-2) Operation of Plasma Generator of Second Embodiment

The operation of the plasma generator 20 of the second embodiment will be described. When the gas to be treated is introduced into the gas introduction path 251, the gas to be treated is divided into the pipes of the plurality of ground electrode 212, flows in the pipes, and is discharged from the common gas discharge path 252. Meanwhile, an AC voltage is applied between each power supply electrode 211 and each ground electrode 212 by the AC power supply 24. As a result, as in the case of the first embodiment, pulsed discharge occurs between each power supply electrode 211 and each ground electrode 212, and the gas to be treated is ionized to generate plasma. The content of the decomposition target in contact with the plasma is decomposed.

According to the plasma generator 20 of the second embodiment, since plasma can be simultaneously generated between a plurality of sets of the power supply electrode 211 and the ground electrode 212, the processing capability of the gas to be treated can be increased.

(2-3) Modification of Plasma Generator of Second Embodiment

Figure 6:
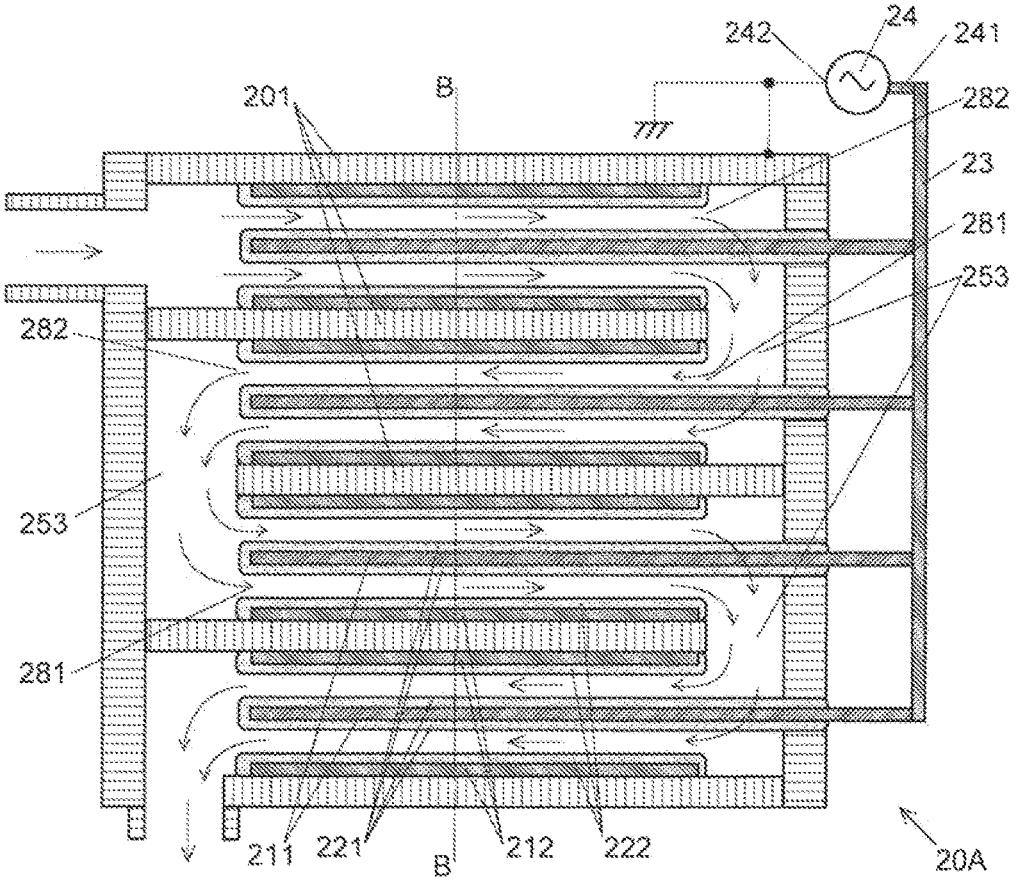
FIG. 6 is a cross-sectional view taken along line A-A illustrating a modification of the plasma generator of the second embodiment.

FIG. 6 is a cross-sectional view taken along line A-A of a plasma generator 20A of a modification of the second embodiment. A cross section taken along line B-B of the plasma generator 20A is similar to that illustrated in FIG. 5. In the plasma generator 20A, sets of the power supply electrode 211 and the ground electrode 212 adjacent to each other are inserted into the holes of the block 201 in directions opposite to each other. Specifically, the gas introduction port 281, which is an opening of the ground electrode 212, which is a linear tube, is arranged on the left side of FIG. 6 in one set, and is arranged on the right side of FIG. 6 in the other set. Each power supply electrode 211 extends to the outside of the tube of the ground electrode 212 on the right side of FIG. 6 (regardless of whether it is on the gas introduction port 281 side or the gas discharge port 282 side), and is electrically connected to the common connection member 23.

Since the sets of each power supply electrode 211 and each ground electrode 212 are arranged as described above, the gas introduction port 281 of one set and the gas discharge port 282 of the other set are adjacent to each other between the adjacent sets. In the block 201, a connection flow path 253 for connecting the gas introduction port 281 of one set and the gas discharge port 282 of the other set adjacent to each other is provided.

As a result, the four tubes of the ground electrodes 212 illustrated in FIG. 6 are connected by the connection flow path 253, and one gas flow path is formed. Three gas flow paths each including a set of four tubes of the ground electrodes 212 are formed in the depth direction of FIG. 6 (the lateral direction of FIG. 5). A hole may be provided in the block 201 so as to further connect these three gas flow paths, and one gas flow path may be formed by the entire plasma generator 20A.

By connecting the pipes of the plurality of ground electrodes 212 to form the gas flow path as described above, the gas to be treated can be brought into contact with the plasma for a longer time while the size of the ground electrode 212 in the longitudinal direction is suppressed, so that the content of the decomposition target in the gas to be treated can be more reliably decomposed.

(3) Plasma Generator of Third Embodiment (3-1) Configuration of Plasma Generator of Third Embodiment A plasma generator of a third embodiment will be described with reference to FIGS. 7 to 9. The plasma generator of the third embodiment includes a plurality of power supply electrodes 311 and a plurality of ground electrodes 312 each having a flat plate shape.

Figure 7:
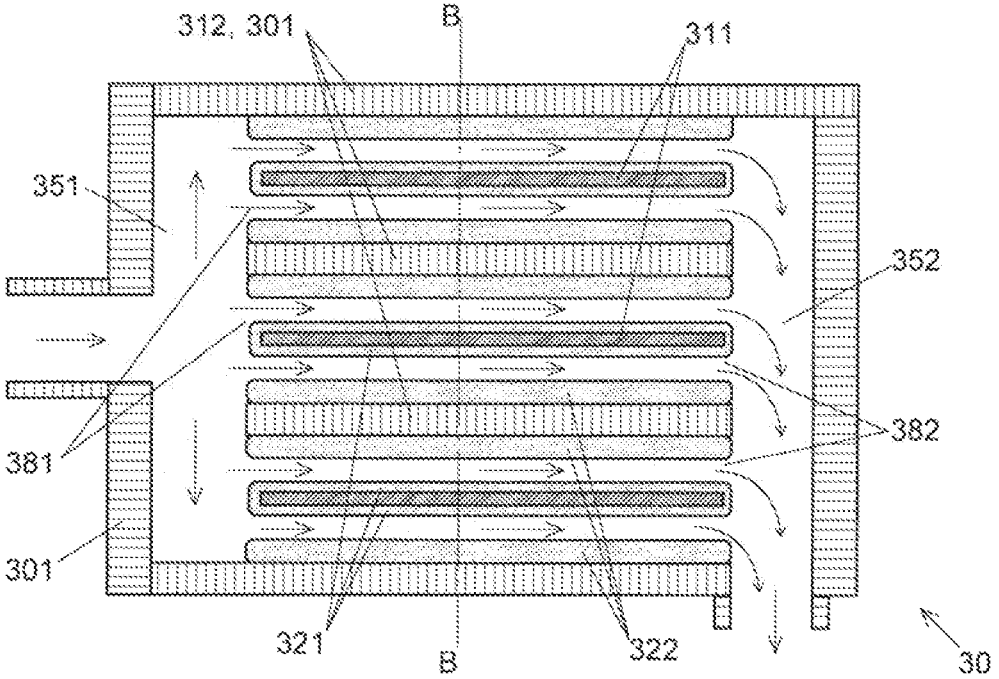
FIG. 7 is a cross-sectional view taken along line A-A illustrating a third embodiment of the plasma generator according to the present invention.
Figure 8:
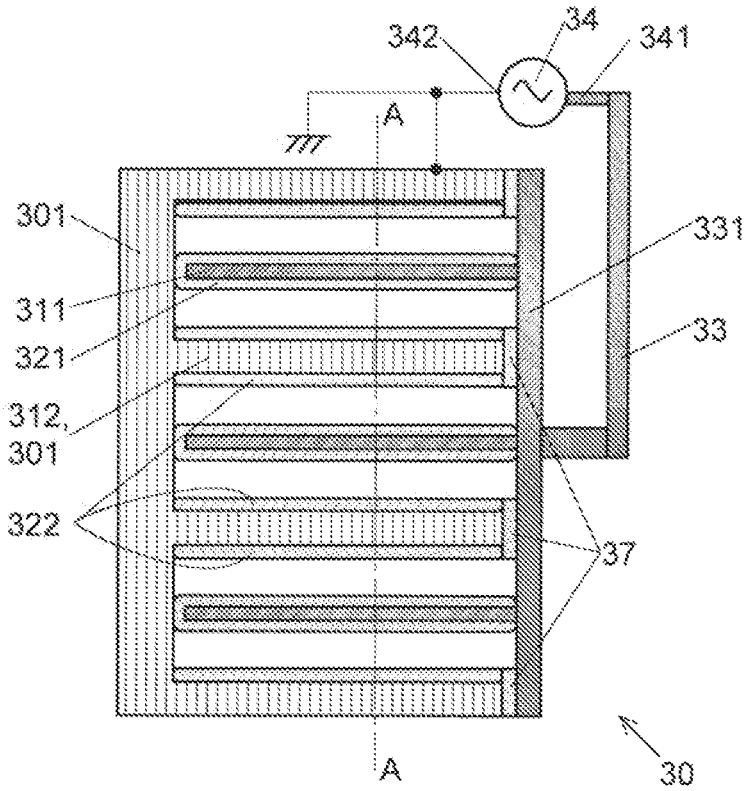
FIG. 8 is a cross-sectional view taken along line B-B of the plasma generator of the third embodiment.

FIGS. 7 and 8 are diagrams illustrating a schematic configuration of a plasma generator 30 of a third embodiment. FIG. 7 illustrates a configuration in the cross section taken along line A-A illustrated in FIG. 8, and FIG. 8 illustrates a configuration in the cross section taken along line B-B illustrated in FIG. 7.

In the plasma generator 30, three holes having a flat plate shape are provided in a conductor block 301 side by side in the longitudinal direction from the right side to the left side in FIG. 8. One power supply electrode 311 having a flat plate shape is inserted into each of the three holes in parallel to the flat plate having the shape of the hole. The upper and lower faces of the block 301 and the conductor of the block 301 left between the holes serve as the ground electrodes 312 having a flat plate shape. Therefore, in this embodiment, the power supply electrodes 311 and the ground electrodes 312 having a flat plate shape are alternately arranged in parallel. A power supply side insulating material 321 is provided on both faces of the power supply electrode 311, and a ground side insulating material 322 is provided on a face of the ground electrode 312 facing the power supply electrode 311. Openings of these holes are airtightly closed by a lid 331 made of a conductor. The lid 331 is electrically insulated from the block 301 by an insulating material 37. Each power supply electrode 311 is in contact with the lid 331. A rod-shaped connection member 33 is further in contact with the lid 331. The connection member 33 is connected to one electrode 341 of an AC power supply 34. An other electrode 342 of the AC power supply 34 is grounded. Note that the connection member 33 may be covered with a non-contact protective cover, or the connection member 33 may be covered with a covering material.

A flow path through which the gas to be treated flows is formed between each power supply electrode 311 and each ground electrode 312. In FIG. 7, the left end of each power supply electrode 311 and each ground electrode 312 is a gas introduction port 381, and the right end is a gas discharge port 382. A gas introduction path 351 communicating with each gas introduction port 381 is provided on the left side of each power supply electrode 311 and each ground electrode 312, and a gas discharge path 352 communicating with each gas discharge port 382 is provided on the right side.

In FIGS. 7 and 8, three sets of the power supply electrode 311 and the ground electrode 312 are provided, but the number of sets is not limited to three. One of the power supply side insulating material 321 and the ground side insulating material 322 may be omitted. Further, in the present embodiment, a part of the block 301 is used as the ground electrode 312, but the ground electrode 312 may be provided separately from the block 301.

(3-2) Operation of Plasma Generator of Third Embodiment

The operation of the plasma generator 30 of the third embodiment will be described. When the gas to be treated is introduced into the gas introduction path 351, the gas to be treated separately flows in the gas flow paths between the plurality of power supply electrodes 311 and the plurality of ground electrodes 312, and is discharged from the common gas discharge path 352. Meanwhile, an AC voltage is applied between each power supply electrode 311 and each ground electrode 312 by the AC power supply 34. As a result, as in the case of the first and second embodiments, pulsed discharge occurs between each power supply electrode 311 and each ground electrode 312, and the gas to be treated is ionized to generate plasma. The content of the decomposition target in contact with the plasma is decomposed.

According to the plasma generator 30 of the third embodiment, since plasma can be simultaneously generated between a plurality of sets of the power supply electrode 311 and the ground electrode 312, the processing capability of the gas to be treated can be increased.

(3-3) Modification of Plasma Generator of Third Embodiment

Figure 9:
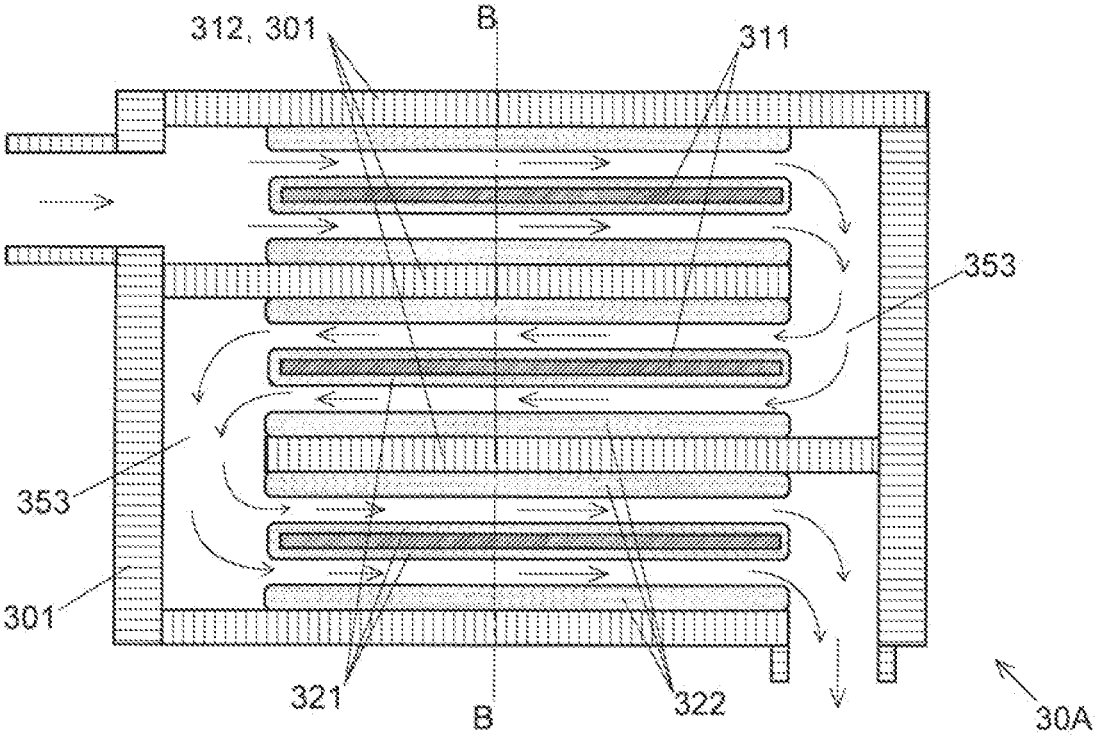
FIG. 9 is a cross-sectional view taken along line A-A illustrating a modification of the plasma generator of the third embodiment.

FIG. 9 is a cross-sectional view taken along line A-A of a plasma generator 30A of a modification of the third embodiment. A B-B cross section of the plasma generator 30A is similar to that illustrated in FIG. 8. In the plasma generator 30A, a gas flow path formed on both upper and lower sides of the first power supply electrode 311 from the top among the three power supply electrodes 311 and a gas flow path formed on both upper and lower sides of the second power supply electrode 311 from the top are connected by providing a connection flow path 353 on the right side of the power supply electrodes 311. Similarly, the gas flow path formed on both upper and lower sides of the second power supply electrode 311 from the top and a gas flow path formed on both upper and lower sides of the third power supply electrode 311 from the top are connected by providing a connection flow path 353 on the left side of the power supply electrodes 311. As a result, a zigzag gas flow path is formed from the first power supply electrode 311 from the top toward the third power supply electrode 311 from the top. In the example of FIG. 9, the case where the number of power supply electrodes 311 is three has been described, but a zigzag gas flow path can be similarly formed in the case where the number of power supply electrodes is two or four or more.

By generating pulsed discharge between each power supply electrode 311 and each ground electrode 312 while causing the gas to be treated to flow through such a zigzag gas flow path, the gas to be treated can be brought into contact with the plasma for a longer time while the size in the direction parallel to the power supply electrode 311 is suppressed, so that the content of the decomposition target in the gas to be treated can be more reliably decomposed.

Although the embodiments and the modifications of the present invention have been described above, it is also possible to combine, for example, a plurality of embodiments and/or modifications or to add and/or change further components within the scope of the gist of the present invention, other than the examples described above.

REFERENCE SIGNS LIST 10, 10A, 10B, 20, 20A, 30, 30A . . . Plasma Generator
111, 211, 311 . . . Power Supply Electrode
112, 212, 312 . . . Ground Electrode
121, 221, 321 . . . Power Supply Side Insulating Material
122, 222, 322 . . . Ground Side Insulating Material
13, 23, 33 . . . Connection Member
14, 24, 34 . . . AC Power Supply
141, 241, 341 . . . Electrode of AC Power Supply
142, 242, 342 . . . Ground Electrode of AC Power Supply
16 . . . Protective Cover
17 . . . Feedthrough
181, 281, 381 . . . Gas Introduction Port
182, 282, 382 . . . Gas Discharge Port
191 . . . Power Measurement Unit
1911 . . . Electric Current Input Terminal
1912 . . . Voltage Input Terminal
1913 . . . Output Terminal
192 . . . Voltage Control Unit
193 . . . Electric Current Waveform Acquisition Unit
1931 . . . Electric Current Input Terminal
1932 . . . Output Terminal
194 . . . Pulse Electric Current Detection Unit
195 . . . Second Voltage Control Unit
201, 301 . . . Block
251, 351 . . . Gas Introduction Path
252, 352 . . . Gas Discharge Path
253, 353 . . . Connection Flow Path
33 . . . Connection Member
331 . . . Lid
37 . . . Insulating Material

The invention claimed is:

1. A plasma generator provided in a gas treatment apparatus for generating plasma by ionizing gas flowing in a gas flow path, the plasma generator comprising:
- an AC power supply;
- a power supply electrode and a ground electrode, one of which is disposed in the gas flow path and the other of which is a conductive wall constituting the gas flow path;
- an inflexible connection member configured to electrically connect the AC power supply and the power supply electrode; and
- an insulating material covering a side of one of the power supply electrode and the ground electrode, the side facing the other electrode.

2. The plasma generator according to claim 1, further comprising a protective cover which is separated from the connection member and covers the connection member.

3. The plasma generator according to claim 1, further comprising:
- a power measurement unit configured to measure AC power output from the AC power supply; and
- a voltage control unit configured to control an AC voltage of the AC power according to the AC power measured by the power measurement unit.

4. The plasma generator according to claim 1, further comprising:
- an electric current waveform acquisition unit configured to acquire a waveform of an AC electric current output from the AC power supply;

a pulse electric current detection unit configured to detect a pulse electric current due to discharge from the waveform of the AC electric current measured by the electric current waveform measurement unit; and a second voltage control unit configured to control an AC voltage of AC power output from the AC power supply according to a pulse repetition frequency of the pulse electric current detected by the pulse electric current detection unit.

5. The plasma generator according to claim 1, comprising a plurality of sets of the power supply electrode and the ground electrode, wherein a common connection member is connected to each of the power supply electrodes.

6. The plasma generator according to claim 5, wherein one of the power supply electrode and the ground electrode is a linear tubular electrode, wherein a plurality of the tubular electrodes are arranged in parallel to each other, and wherein the plasma generator further includes a connection flow path configured to connect adjacent openings of the adjacent tubular electrodes.

7. The plasma generator according to claim 1, wherein a plurality of the power supply electrodes and a plurality of the ground electrodes are alternately arranged, and wherein a common connection member is connected to each of the power supply electrodes.

8. The plasma generator according to claim 7, wherein the power supply electrode and the ground electrode are flat plate electrodes, and wherein the plasma generator further includes a connection flow path configured to connect adjacent gas flow paths each formed between one of the power supply electrode and the ground electrode and the other of the power supply electrode and the ground electrode.

* * * * *